US005329844A

United States Patent [19]

Koivukunnas et al.

[11] Patent Number: 5,329,844

[45] Date of Patent: Jul. 19, 1994

[54] CALENDER WITH PIVOTALLY DISPLACEABLE ROLL

[75] Inventors: Pekka Koivukunnas, Järvenpää ; Juha Honkala, Helsinki; Risto Turunen, Jyväskylä ; Juhani Niskanen, Muurame; Ville Korhonen; Timo Pirinen, both of Jyväskylä all of Finland

[73] Assignee: Valmet Paper Machinery Inc., Helsinki, Finland

[21] Appl. No.: 774,460

[22] Filed: Oct. 10, 1991

[30] Foreign Application Priority Data

Oct. 11, 1990 [FI] Finland ..... 905001

[51] Int. Cl.[5] ..... B30B 15/34; B30B 3/04; D21G 1/02

[52] U.S. Cl. ..... 100/93 RP; 100/162 R; 100/163 R; 100/166; 100/169

[58] Field of Search ..... 100/93 RP, 161, 162 R, 100/163 R, 166, 168, 169

[56] References Cited

U.S. PATENT DOCUMENTS 4,077,316 3/1978 Georget ..... 100/169 X
4,326,456 4/1982 Kankaanpaa ..... 100/162 R X
4,471,690 9/1984 Yamaguchi et al. ..... 100/162 R
4,632,655 12/1986 Benkwitz ..... 100/162 R X

FOREIGN PATENT DOCUMENTS 1299528 7/1969 Fed. Rep. of Germany ..... 100/168
1561739 4/1970 Fed. Rep. of Germany ... 100/163 R
2603485 8/1977 Fed. Rep. of Germany ..... 100/161
46-28965 8/1971 Japan ..... 100/161
829755 5/1981 U.S.S.R. ..... 100/161

*Primary Examiner*—Stephen F. Gerrity
*Attorney, Agent, or Firm*—Smith-Hill and Bedell

[57] ABSTRACT

A calender in a paper or board machine comprises a calender frame, at least two soft-faced rolls mounted on the calender frame and at least one hard roll mounted on the calender frame in a manner that allows the hard roll to be displaced between a first position in which it forms calendering nips with the two soft-faced rolls and a second position in which it is spaced from the soft-faced rolls. During threading of the web; while the calender is in operation, the hard roll is shifted to its second position, the web is passed over the soft-faced rolls, and the hard roll is shifted back to its first position and brings the web into the nips between the hard roll and the soft-faced rolls.

17 Claims, 2 Drawing Sheets

CALENDER WITH PIVOTALLY DISPLACEABLE ROLL

BACKGROUND OF THE INVENTION

This invention relates to a calender in a paper or board machine, particularly a calender comprising at least two soft-faced rolls and at least one hard roll that forms calendering nips with the two soft-faced rolls.

A soft calender in a paper machine usually consists of two nips placed one after the other. Each nip is formed by one hard roll and one soft-faced roll. This type of calender is used in order to facilitate the threading of the web. In an on-line soft calender, it must be possible to thread the web through the nips at full speed. In a calender consisting of two rolls, such threading of the web is possible because the web can run along a linear path. In a calender with three rolls, however, the path of the web is more complicated and the threading is more difficult. Since a soft-faced roll is easily damaged, threading cannot be carried out in the same way as in a calender with hard rolls. In the existing calenders with three rolls, the threading has been carried out while the calender is stationary, or the web has been threaded between the rolls, e.g., by means of air jets or ropes. For the threading, the nips of the calender have been opened. With the prior-art solutions known to the applicants, threading at high web speeds has not been possible at all.

SUMMARY OF THE INVENTION

The object of the present invention is in particular to provide an improvement over the prior-art three-roll soft calenders and to provide calender in which the threading of the web can be carried out at full web speed, so that the calender can be used as a so-called on-line calender.

In accordance with a first aspect of the present invention there is provided a calender in a paper or board machine, comprising a calender frame, at least two soft-faced rolls mounted on the calender frame, and at least one hard roll mounted on the calender frame in a manner that allows the hard roll to be displaced between a first position in which it forms calendering nips with the two soft-faced rolls and a second position in which it is spaced from the soft-faced rolls, whereby a web can be threaded by shifting the hard roll to its second position, passing the web over the soft-faced rolls, and shifting the hard roll back to its first position so that the web is brought into the nips between the hard roll and the soft-faced rolls.

In accordance with a second aspect of the present invention there is provided a calender in a paper or board machine, comprising a calender frame, at least first, second and third rolls, first and second bearing means supporting the first and second rolls respectively relative to the calender frame in spaced apart relationship, and roll support means supporting the third roll relative to the frame in a manner that allows the third roll to be displaced between a first position in which it forms calendering nips with the first and second rolls respectively and a second position in which it is spaced from the first and second rolls, whereby a web can be threaded by shifting the third roll to its second position, passing the web between the third roll and the first and second rolls, and shifting the third roll back to its first position so that the web is brought into the nips between the third roll and the first and second rolls.

Threading of a calender in accordance with the invention can be carried out while the machine runs at full web speed, without stopping the calender or even slowing it down substantially. Therefore, the calender can be used as an on-line calender. The hard roll of a calender in accordance with the invention may be a hot roll, so that the invention can also be applied to hot calendering. Further advantages and features of the invention will become apparent from the following detailed description of the invention.

BRIEF DESCRIPTION OF THE DRAWINGS

In the following, the invention will be described by way of example with reference to the figures of the accompanying drawings. In the drawings.

DETAILED DESCRIPTION

Figure 1:
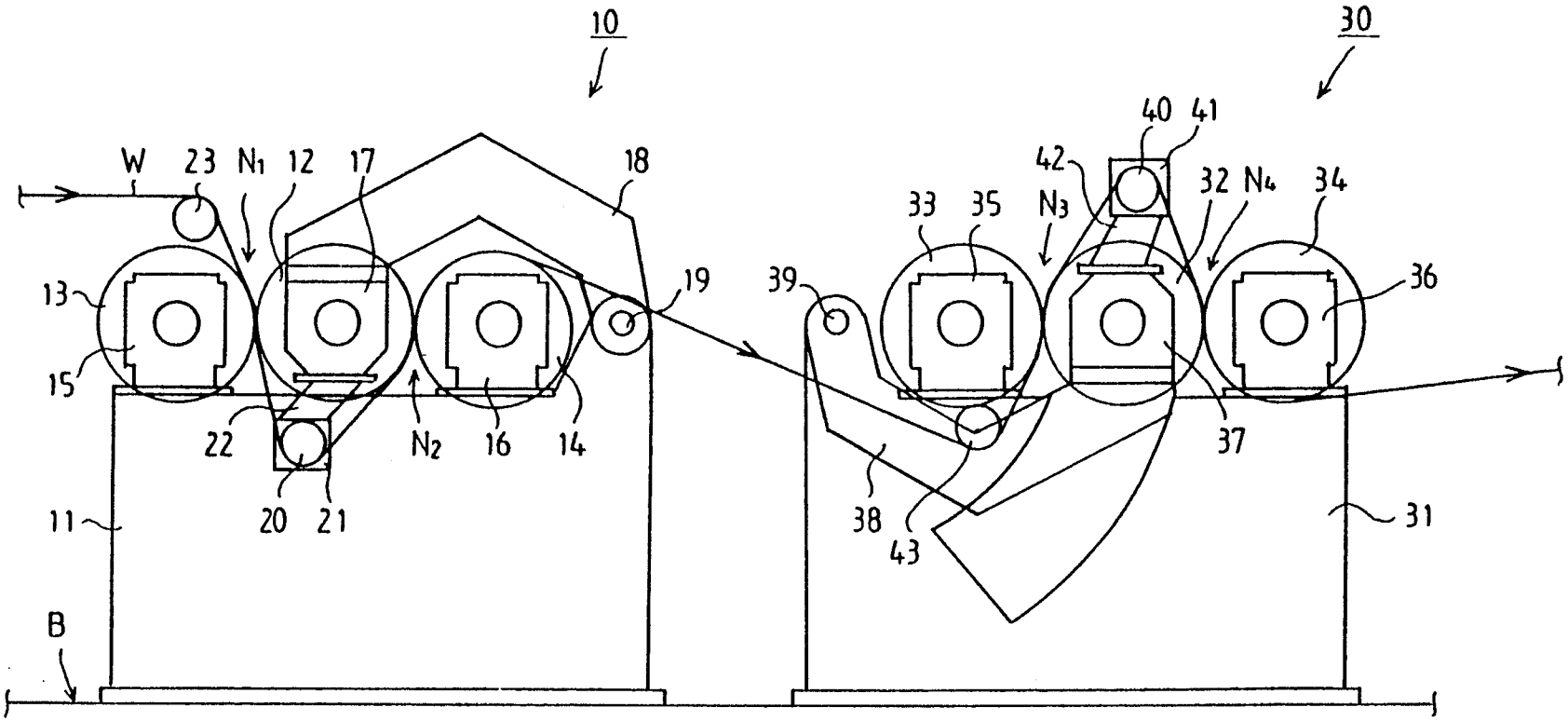
FIG. 1 shows a calender unit comprising two calenders in accordance with the invention, fitted one after the other, during operation.

The calendering unit shown in FIG. 1, which comprises two calenders 10,30 fitted one after the other, is intended for two-sided calendering of the web W, i.e. for calendering in which each side of the web W contacts a hard roll. If it is not necessary that the web W be calendered in the same way at both sides, it is possible to use just one calender 10 or 30 in the calendering unit.

Thus, in FIG. 1, the first calender in the calendering unit is denoted generally with the reference numeral 10. The calender 10 comprises a calender frame 11 mounted on a base B, on which frame two soft-faced rolls 13 and 14 are mounted for rotation by means of bearing brackets 15 and 16. Between the soft-faced rolls 13,14, a hard roll 12 is supported by bearing brackets 17. The hard roll 12, which may be a driving roll, forms calendering nips $N_1$ and $N_2$ with the soft-faced calender rolls 13 and 14. The calender 10 is a three-roll so-called horizontal calender, in which the nip planes of both nips $N_1$ and $N_2$ are substantially coplanar and are substantially in a horizontal plane.

The bearing brackets 15,16 of the soft-faced calender rolls 13,14 are preferably mounted on the calender frame 11 by means of levers or on guides that are parallel to the nip plane, so that the soft-faced rolls 13,14 are displaceable in the direction of the nip plane. Moreover, said rolls 13,14 are preferably provided with loading cylinders (not shown), by means of which the rolls 13,14 can be loaded in the direction of the nip plane so as to adjust the linear loads in the calendering nips $N_1$ and $N_2$ to a suitable level.

The bearing brackets 17 of the hard roll 12 are mounted on pivot arms 18, which are linked pivotally on the calender frame 11 by means of an articulation shaft 19 extending transverse to the machine direction. Therefore, the hard roll 12 can be pivoted on the pivot arms 18 out of the common nip plane and positioned so that it is above the soft-faced rolls 13,14.

In the embodiment shown in FIG. 1, a bearing bracket 21 is attached to the bearing bracket 17 of the hard roll 12 by means of a frame piece 22, and a takeoff roll 20 is mounted for rotation on the bracket 21. By means of the takeoff roll 20, which may be a driving roll, the web W can be separated from the face of the hard roll 12 between the first and second nips $N_1$ and $N_2$. The takeoff roll 20 is needed in particular when the calender 10 is used for hot calendering, i.e., when the hard roll 12 is a hot roll, because in this case it is usually desirable that the web W be separated from the face of the hot roll as soon as possible after leaving the first nip $N_1$.

It will be noted from FIG. 1 that even with the takeoff roll 20 the web does not leave the nip $N_1$ or enter the nip $N_2$ linearly, but extends somewhat along the face of the hot roll. However, instead of one takeoff roll 20, it is possible to use several takeoff rolls, for example two takeoff rolls, in the calender 10, by means of which rolls the web W could be guided away from the face of the hard roll 12 after the first nip $N_1$ in an even more linear way than is shown in FIG. 1, and, correspondingly, the web could be guided in a more linear way into the second nip $N_2$. If the calender 10 is not used for hot calendering, so that the hard roll 12 is not a hot roll, in many cases it is acceptable for the web W to run from the first nip $N_1$ into the second nip $N_2$ on the face of the hard roll 12 and then no takeoff roll 20 is required in the calender 10.

A guide roll 23 is fitted on the calender frame 11, and the web is guided into the first nip $N_1$ of the calender over the guide roll 23.

The passage of the web W in the calender 10 is as follows. The web W enters the calender 10 as guided by the guide roll 23, which guides the web W into the first nip $N_1$ formed by the first soft-faced roll 13 and the hard roll 12. After the first nip $N_1$, the web is guided away from the face of the hard-faced center roll 12 by means of the takeoff roll 20, and, having run over said roll 20, the web W enters the second nip $N_2$. From the second nip $N_2$ the web W passes over the second soft-faced roll 14 to the second calender 30 in the calendering unit to calender the other side of the web W in a corresponding way.

The construction of the second calender 30 in the calendering unit largely corresponds to the construction of the first calender 10. Thus, on the calender frame 31, two soft-faced rolls 33 and 34 are mounted for rotation by means of bearing brackets 35 and 36. Between the first and second soft-faced rolls 33,34, a hard roll 32 is supported by bearing brackets 37. The bearing brackets 37 of the hard roll 32 are mounted on pivot arms 38, which are mounted pivotally on the calender frame 32 by means of an articulation shaft 39 extending transverse to the machine direction. The hard roll 32 forms calendering nips $N_3$ and $N_4$ with said two soft-faced calender rolls 33 and 34. The bearing brackets 35,36 are preferably mounted on the frame 31 by means of levers or on guides parallel to the nip plane. The bearing brackets 35,36 can be displaced in the nip plane on the levers or guides by means of loading cylinders (not shown) to adjust the linear loads in the calendering nips $N_3$ and $N_4$.

In similar fashion to the first calender 10 in the calendering unit, a bearing bracket 41 is mounted on the bearing bracket 37 of the hard roll 32 by means of a frame piece 42 and a takeoff roll 40 is mounted for rotation on the bearing bracket 41. The takeoff roll 40 serves a purpose corresponding to that described in relation to the takeoff roll 20 of the first calender 10.

The web W from the second calendering nip $N_2$ of the first calender 10 passes over the second soft-faced roll 14 into the second calender 30, where the web W is first guided over the guide roll 43 into the first nip $N_3$ defined by the first soft-faced roll 33 and the hard roll 32. After the first nip $N_3$, the web W is guided away from the face of the hard roll 32 by means of the takeoff roll 40, over which the web W passes and enters the second nip $N_4$. From the second nip $N_4$, the web W passes to further processing over the second soft-faced roll 34.

Figure 2:
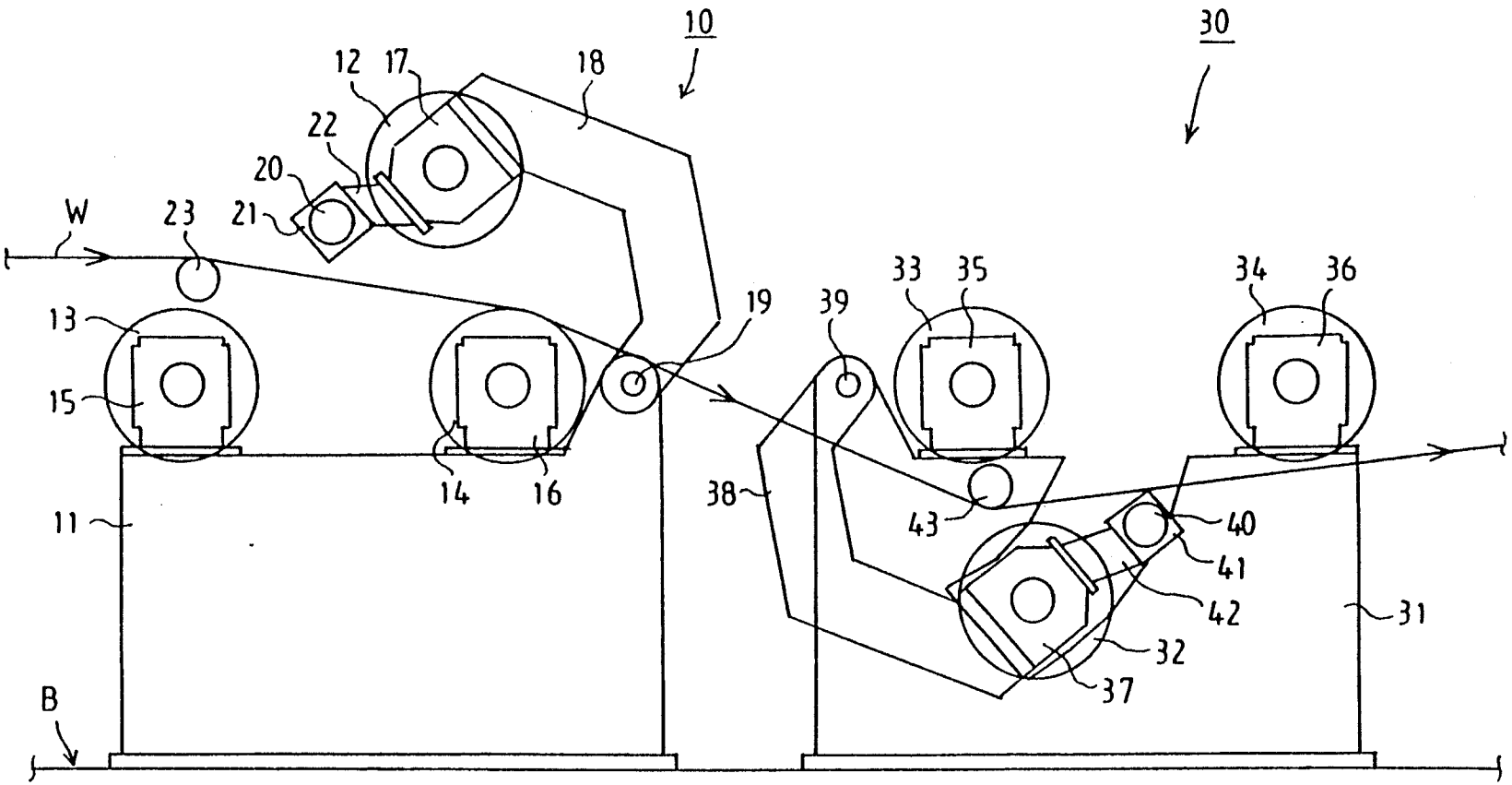
FIG. 2 shows the calendering unit of FIG. 1 during threading of the web.

In FIG. 2, the calendering unit is shown in the web W threading situation. For the threading of the web W, the pivot arms 18,38 of the hard rolls 12,32 in both calenders 10,30 have been pivoted around the articulation shafts 19,39 so that the hard rolls 12,32 are shifted out of the nip line and out of the path of the web W. In the first calender 10, said shifting has been performed upwards, and in the second calender 30 downwards. Since the bearing brackets 21,41 of the takeoff rolls 20,40 are attached directly to the bearing brackets 17,37 by means of the frame pieces 22,42, the takeoff rolls 20,40 are shifted along with the hard rolls 12,32. After the pivot arms 18, 38 have been pivoted far enough so that both the hard rolls 12,32 and the takeoff rolls 20,40 are completely out of the path of the web W, i.e. the hard roll 12 and the takeoff roll 20 are above the upper common tangent of the soft-faced rolls 13,14 and the hard roll 32 and the takeoff roll 40 are below the lower common tangent of the soft-faced rolls 33,34, the threading of the web can be accomplished easily because the web W need not be threaded through any nip. In the threading situation, the web W runs over the guide roll 23 and the second soft-faced roll 14 of the first calender into the second calender 30, where, in the embodiment of FIG. 2, the web W contacts only the guide roll 43. The hard rolls 12,32 are then returned to their calendering positions and the web is brought into the nips $N_1$–$N_4$, which are automatically re-established.

As shown in FIG. 2, the threading of the web W through the whole calendering unit is essentially linear, and therefore the threading can be carried out at full speed and the calenders 10,30 can be used as on-line calenders.

Above, the invention has been described by way of example with reference to the figures in the accompanying drawings. The invention is, however, not confined to the exemplifying embodiment shown in the figures alone, but different embodiments of the invention may show variation within the scope of the inventive idea defined in the accompanying patent claims. Thus, the invention can also be applied to a calender with a larger number of rolls, and for example, to a supercalender in which the stack of rolls consists of alternating hard and soft-faced rolls. For threading of the web in such multi-roll calenders, every second roll (hard roll) in the stack of rolls is shifted aside, so that the web does not have to be threaded through the nips, but it can be passed directly across the calender and then brought into the nips by returning the hard rolls to their calendering positions.

We claim:

1. A calender in a paper or board machine, comprising:

a calender frame, at least two soft-faced rolls mounted on the calender frame, roll support means connected to the calender frame for pivotal movement relative to the calender frame about a pivot axis transverse tot eh machine direction, and at least one hard roll mounted on the roll support means, so that by pivotal movement of the roll support means the hard roll can be displaced between a first position in which it forms calendering nips with the two soft-faced rolls and a second position in which it is spaced from the soft-faced rolls, whereby the web can be threaded by shifting the hard roll to its second position, passing the web over the soft-faced rolls, and shifting the hard roll back to its first position so that the web is brought into the nips between the hard roll and the soft-faced rolls.

2. A calender according to claim 1, wherein the second position of the hard roll is such that, in the threading of the web, the web can pass across the soft-faced rolls without contracting said soft-faced rolls.

3. A calender according to claim 1, wherein the second position of the hard roll is such that, in threading of the web, the web can pass across the soft-faced rolls along the face of at least one of the soft-faced rolls.

4. A calender according to claim 1, wherein the roll support means comprises bearing brackets supporting the hard roll and pivot arms that support the bearing brackets and are pivotally linked to the calender frame on said pivot axis.

5. A calender according to claim 1, comprising bearing brackets supporting the hard roll, the bearing brackets being mounted on the calender frame for movement relative thereto.

6. A calender according to claim 5, further comprising a takeoff roll and bearing brackets supporting the takeoff roll at a fixed location relative to the bearing brackets of the hard roll so that the takeoff roll is displaced along with the hard roll.

7. A calender according to claim 1, wherein the hard roll is a driving roll.

8. A calender according to claim 1, wherein the hard roll is a hot roll.

9. A calender according to claim 1, comprising a takeoff roll associated with the hard roll, said takeoff roll being a driving roll.

10. A calender according to claim 1, wherein a single continuous space is defined between the two soft face rolls and two planes that are tangential to each of the soft face rolls, and wherein the hard roll is outside said space when it is in its second position.

11. A calender according to claim 1, further comprising a takeoff roll mounted on the roll support means.

12. A calender in a paper or board machine, comprising:

a calender frame, at least first, second and third rolls, first and second bearing means supporting the first and second rolls respectively relative to the calender frame in spaced apart relationship, roll support means connected to the calender frame for pivotal movement relative to the calender frame about a pivot axis transverse to the machine direction, said roll support means supporting the third roll so that by pivotal movement of the roll support means the third roll can be displaced between a first position in which it forms calendering nips with the first and second rolls respectively and a second position in which it is spaced from the first and second rolls, whereby a web can be threaded by shifting the third roll to its second position, passing the web between the third roll and the first and second rolls, and shifting the third roll back to its first position so that the web is brought into the nips between the third roll and the first and second rolls, and a takeoff roll mounted on the roll support means.

13. A calender according to claim 12, wherein the roll support means comprises bearing brackets supporting the third roll and pivot arms that support the bearing brackets and are pivotally linked to the calender frame on said pivot axis.

14. A calender according to claim 12, wherein a single continuous space is defined between the first and second rolls and two planes that are tangential to each of the first and second rolls, and wherein the third roll is outside said space when it is in its second position.

15. Calender apparatus in a paper or board machine, said calender apparatus comprising:

a calender frame structure, at least first, second, third, fourth, fifth and sixth calender rolls, first, second, third and fourth bearing means supporting the first, second, third and fourth rolls respectively relative to the calender frame structure in horizontally spaced apart relationship, with the second roll between the first and third rolls and the third roll between the second and fourth rolls, roll support means supporting the fifth roll relative to the calender frame structure in a manner that allows the fifth roll to be displaced upwards form a first position in which it forms calendering nips with the first and second rolls respectively and a second position in which it is above the first and second rolls and is spaced therefrom, and supporting the sixth roll relative to the calender frame structure in a manner that allows the sixth roll to be displaced downwards from a first position in which it forms calendering nips with the third and fourth rolls respectively and a second position in which it is below the third and fourth rolls and is spaced therefrom, whereby a web can be threaded by shifting each of the fifth and sixth rolls to its second position, passing the web between the fifth roll and the first and second rolls, passing the web between the sixth roll and the third and fourth rolls, and shifting each of the fifth and sixth rolls back to its first position so that the web is brought into the nips between the fifth roll and the first and second rolls and between the sixth roll and the third and fourth rolls.

16. Calender apparatus according to claim 15, wherein the roll support means comprise first pivot arm means connected to the calender frame structure for pivotal movement relative to the calender frame structure about a first horizontal pivot axis transverse to the machine direction for supporting the fourth roll and second pivot arm means connected to the calender frame structure for pivotal movement relative to the calender frame structure about a second horizontal pivot axis transverse to the machine direction for supporting the sixth roll, so that the fifth and sixth rolls can each be displaced between its first position and its second position by pivotal movement.

17. Calender apparatus according to claim 15, further comprising first and second takeoff rolls mounted on the roll support means for movement with the fifth and sixth calender rolls respectively.

* * * * *